United States Patent [19]

Yoshimura et al.

[11] Patent Number: 4,886,614

[45] Date of Patent: Dec. 12, 1989

[54] SYNTHETIC TRACTION FLUID

[75] Inventors: Narihiko Yoshimura; Hirotaka Tomizawa; Yasuji Komatsu, all of Saitama, Japan

[73] Assignee: Toa Nenryo Kogyo, K.K., Tokyo, Japan

[21] Appl. No.: 65,827

[22] Filed: Jun. 23, 1987

[51] Int. Cl.[4] ..... C09K 5/00

[52] U.S. Cl. ..... 252/79; 252/56 D; 252/56 R; 252/56 S; 560/1; 560/193; 560/204

[58] Field of Search ..... 560/1, 193; 252/56 R, 252/56 S, 56 D, 79

[56] References Cited

U.S. PATENT DOCUMENTS

| | | | |
|---|---|---|---|
| 2,807,638 | 9/1957 | Morris et al. | 560/1 |
| 4,343,652 | 8/1982 | Allart et al. | 427/151 |
| 4,464,277 | 8/1984 | Cousineau | 252/56 |
| 4,507,408 | 3/1985 | Torbus et al. | 523/143 |
| 4,514,190 | 4/1985 | Cousineau et al. | 44/70 |
| 4,645,855 | 2/1987 | Reuvers et al. | 560/204 |

FOREIGN PATENT DOCUMENTS 786950 11/1957 United Kingdom .

OTHER PUBLICATIONS

Acylation of Glycerol. Ismailov, A. G.,; Salimova, 1971, No. 2, 49–54 (Russ.) From Ref. Zh., Khim, 1972, Abstr. No. 4Zh180.

Chemical Abstracts vol. 75, (117944b, (1971).

*Primary Examiner*—Werren B. Lone
*Assistant Examiner*—Vera C. Clarke
*Attorney, Agent, or Firm*—M. B. Kapustij

[57] ABSTRACT

A traction fluid comprising a diester or its derivative represented by the formula

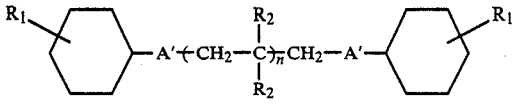

wherein:

A40 is an ester linkage of —COO— or —OOC—;

n is an integer of 1 to 6;

$R_1$ is independently selected from hydrogen and alkyl groups containing 1 to 8 carbon atoms; and $R_2$ is independently selected from alkyl groups containing from 1 to 3 carbon atoms.

11 Claims, No Drawings

SYNTHETIC TRACTION FLUID

FIELD OF THE INVENTION

This invention relates to a traction fluid. More particularly, the present invention is concerned with a traction fluid comprising a diester or its derivative having two cyclohexyl rings as the base oil.

BACKGROUND OF THE INVENTION

Traction drive power transmissions, which transmit power to a driven part through a traction drive mechanism, have recently attracted attention in the field of automobiles and industrial machinery. The traction drive mechanism is a power transmitting mechanism using a rolling friction. Unlike conventional drive mechanisms it does not use any gears, which results in reduced vibration and noise as well as a smooth speed change in high-speed rotation. An important goal in the automobile industry is improvement in the fuel consumption of automobiles. It has been suggested that if the traction drive is applied to the transmission of automobiles to convert the transmission to the continuous variable-speed transmission fuel consumption can be reduced by at least 20% compared to conventional transmission systems. This is due to the fact that the drive can always be in the optimum speed ratio. Recent studies have resulted in the development of materials having high fatigue resistance as well as in a theoretical analysis of traction mechanisms. As regards the traction fluid the correlation of traction coefficients is gradually being understood on a level of the molecular structure of the components. The term "traction coefficient" as used herein is defined as the ratio of the tractional force which is caused by slipping at the contact points between rotators which are in contact with each other in a power transmission of the rolling friction type to the normal load.

The traction fluid is comprised of a lubricating oil having a high traction coefficient. It has been confirmed in this connection that a traction fluid possessing a molecular structure having a naphthene ring exhibits high performance. "Santotrack®" manufactured by the Monsanto Chemical Company is widely known as a commercially available traction fluid. Japanese patent publication No. 35763/1972 discloses di(cyclohexyl)alkane and dicyclohexane is traction fluids having a naphthene ring. This patent publication discloses that a fluid obtained by incorporating the above-mentioned alkane compound in perhydrogenated (α-methyl)styrene polymer, hydrindane compound or the like has a high traction coefficient. Further, Japanese patent laid-open No. 191797/1984 discloses a traction fluid containing an ester compound having a naphthene ring. It discloses that an ester obtained by the hydrogenation of the aromatic nucleus of dicyclohexyl cyclohexanedicarboxylate or dicyclohexyl phthalate is preferred as the traction fluid.

As mentioned above, in recent years there has been progress in the development of continuous variable-speed transmissions. The higher the traction coefficient of the lubricating fluid the larger the transmission force in the same device. This allows a reduction in size of the entire device with a concomitant reduction in polluting exhaust gases. Therefore, there is a demand for a fluid having a traction coefficient as high as possible. However, even the use of Santotrack®, which is a traction fluid having the highest performance of all the currently commercially available fluids, in such a traction drive device provides unsatisfactory performance with respect to the traction coefficient, and is also expensive. The traction fluid which has been proposed in Japanese patent publication No. 35763/1971 contains Santotrack® or its analogue as a component and, therefore, is also unsatisfactory with respect to its performance and cost The present inventors have made extensive and intensive studies with a view to developing a traction fluid which not only exhibits a high traction coefficient but is also inexpensive. As a result, the inventors have found that the use of a diester or its derivative having two cyclohexyl rings can economically provide a high-performance base oil fluid. The present invention has been made based on this finding.

SUMMARY OF THE INVENTION

A traction fluid exhibiting a high traction coefficient comprising a diester or its derivative containing two cyclohexyl or alkyl substituted cyclohexyl moieties connected to ester bonds to an acyclic hydrocarbyl radical.

DETAILED DESCRIPTION OF THE INVENTION

According to the present invention there is provided a traction fluid comprising a diester or its derivative represented by the following general formula:

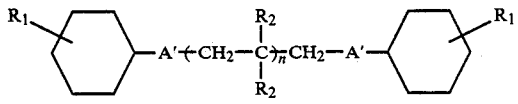

wherein A' is an ester linkage of —COO— or —OOC—, n is an integer of 1 to 6, $R_1$ is independently selected from a hydrogen atom and alkyl groups having 1 to 8 carbon atoms, and $R_2$ is independently selected from alkyl groups having 1 to 3 carbon atoms.

A first object of the present invention is to provide a high-performance traction fluid having a high traction coefficient. A second object of the present invention is to provide fluid which is not only economical but also readily available and easily applicable to transmissions.

The traction fluid of the present invention comprises a diester or its derivative of the aforedescribed structural formula having two cyclohexyl rings. A' of the ester linkage is —COO— or —OOC—, and the number, n, of the repeating units of gem-dialkyl structure is 1 to 6, preferably 1 to 3. When n is zero, the traction coefficient is low, while when n is 7 or more the viscosity is too high. This diester or derivative thereof has a viscosity of 20 to 50 cts, preferably 24 to 30 cst at 40° C., and 4 to 10 cst, preferably 4 to 6 cst at 100° C. Further, the viscosity index is preferably in the range of 40 to 100, particularly preferably in the range of 50 to 80.

The diester can be prepared by the following method. Specifically, the diester can be obtained by the esterification reaction of a glycol compound with a cyclohexanecarboxylic acid compound. The glycol compound to be used has 1 to 6 gem-dialkyl structural units. A preferred glycol compound is neopentyl glycol. Examples of the cyclohexanecarboxylic acid compounds include, besides cyclohexanecarboxylic acid, those having an alkyl group with 1 to 8 carbon atoms, e.g., methylcyclohexanecarboxylic acid, ethylcyclohexanecarboxylic acid, etc. Cyclohexanecarboxylic acid is particularly preferred. The esterification reaction is conducted using substantially stoichiometric amounts of the reactants or in the presence of an excess amount of the acid. The former method requires the use of a catalyst and further has the problem that a monoalcohol is produced as the by-product. Therefore, it is preferred that the esterification reaction be conducted in the presence of an excess amount of the acid. Specifically, 1 mol of the glycol compound is reacted with the acid in 2 to 5-fold mol excess (particularly preferable in 2.5 to 4-fold mol excess). The reaction temperature is about 150° and 250° C., preferably 170° to 230° C., and the reaction time is 10 to 40 hrs., preferably 15 to 25 hrs. Although the esterification reaction may be conducted under either elevated or reduced pressures, it is preferred that the reaction be conducted at atmospheric pressure from the standpoint of ease of reaction operation. Under this condition the excess acid serves as a catalyst. An alkylbenzene such as xylene or toluene can be added in a suitable amount as a solvent. The addition of the solvent enables the reaction temperature to be easily controlled. As the reaction proceeds water formed during the reaction evaporates. The reaction is terminated when the amount of water reaches twice by mol that of the alcohol. The excess acid is neutralized with an aqueous alkaline solution and removed by washing with water. When an acid which is difficult to extract with an alkali washing is used the reaction is conducted using the acid in an amount of 2 to 2.5-fold mol excess over the alcohol in the presence of a catalyst. Examples of the catalyst include phosphoric acid, p-toluenesulfonic acid and sulfuric acid. The most preferred catalyst is phosphoric acid because it enhances the reaction rate and increases the yield of the ester. The reaction product is finally distilled under reduced pressure to remove water and the solvent, thereby obtaining the diester compound of the present invention.

The diester of the present invention can also be prepared by the esterification reaction of a cyclohexanol compound with a dicarboxylic acid having a quaternary carbon atom. In this case, cyclohexanol, methylcyclohexanol or the like is used as the cyclohexanol compound, while neopentyldicarboxylic acid or the like is used as the dicarboxylic acid.

The diester of the present invention, e.g., neopentyl glycol cyclohexanecarboxylic acid diester, exhibits a traction coefficient of 0.100 to 0.104. Therefore, even when the diester is used alone in a traction drive device it exhibits high performance. Further, a second component may be added to the diester. The second component is a compound which not only improves the traction coefficient through a synergistic effect with the cyclohexyl rings but also is inexpensive and exhibits excellent viscosity characteristics. The addition of such a second component of the diester enables economically advantageous production of a traction fluid. The amount of the second component added is usually 0.01 to 90% by weight, particularly preferably 0.1 to 70% by weight.

Various additives may also be added to the traction fluid of the present invention depending on its applications. Specifically, when the traction device undergoes a high temperature and a large load at least one additive selected from among an antioxidant, a wear inhibitor and a corrosion inhibitor may be added in an amount of 0.01 to 5% by weight. Similarly, when a high viscosity index is required a known viscosity index improver is added in an amount of 1 to 10% by weight.

The term "traction fluid" as used in the present invention is intended to mean a fluid for use in devices which transmit a rotational torque through point contact or line contact, or for use in transmissions having a similar structure. The traction fluid of the present invention exhibits a traction coefficient higher than those of conventionally known fluids, i.e., exhibits a traction coefficient 1 to 5% higher than those of the conventional fluids, although the value varies depending on the viscosity. Therefore, the traction fluid of the present invention can be advantageously used for relatively low power drive transmissions including internal combustion engines of small passenger cars, spinning machines and food producing machines, as well as large power drive transmissions such as industrial machines, etc.

The traction fluids of the present invention exhibit remarkably superior traction coefficients vis-a-vis conventional fluids. The reason why the traction fluid of the present invention exhibits a high traction coefficient is not yet fully understood. However, basically, the reason is believed to reside in the unique molecular structure of the traction fluid of the present invention.

The traction fluid of the present invention comprises a diester. The diester has two cyclohexyl rings in its molecule which are bonded to each other through two ester linkages. The two ester linkages bring about an interdipolar force between the molecules. It is believed that the interdipolar force serves to bring the fluid into a stable glassy state under high load conditions, thereby increasing the shearing force. Further, the traction fluid of the present invention has a quaternary carbon atom of the gem-dialkyl type which is bonded to the two cyclohexyl rings through a methoxycarbonyl linkage. This suppresses internal rotation. Therefore, when the traction device is under high load conditions the cyclohexyl rings are firmly engaged, like gears, with the gem-dialkyl portion of the quaternary carbon atom, while when the device is released from the load this engagement is broken thereby causing fluidization.

The following Examples are provided for illustrative purposes only and are not to be construed as limiting the invention herein described.

EXAMPLES 1-3

Diester compounds of dicyclohexyl neopentyl glycol according to the present invention were synthesized using the following materials.

A1: Neopentyl glycol and cyclohexanecarboxylic acid,

A2: Neopentyl glycol and methylcyclohexanecarboxylic acid, and

A3: Neopentyl glycol and a mixture of cyclohexanecarboxylic acid with methylcyclohexanecarboxylic acid (the molar ratio of the acids is 1:1.). The diesters were prepared using xylene as a solvent at a temperature of 170° C. 230° C., for 15~25 hours and under the atmospheric pressure.

The traction coefficient of the diesters thus produced was measured under the following conditions:

measurement equipment: Soda-type four roller traction testing machine.

test conditions: a fluid temperature of 20° C.; a roller temperature of 30° C.; a mean Hertzian pressure of 1.2 GPa; a rolling velocity of 3.6 m/s; and a slipping ratio of 3.0%.

As illustrated by the data in Table I, the traction fluid of the present invention was remarkably superior in its traction performance to the conventional traction fluids.

COMPARATIVE EXAMPLES 1–4

A commercially available traction fluid B (Santotrack® by the Monsanto Chemical Company), commercially available naphthenic compounds C1 and C2 (having 1 to 3 cyclohexyl rings) and phthalic acid dicyclohexyl ester D were used as the comparative samples. Traction coefficients of these comparative samples were measured in the same method as described in the above Examples. The results are shown in Table 1.

As can be seen from Table 1 all the comparative samples exhibited traction coefficients 10 to 15% smaller than those of the diester compounds of the present invention.

TABLE 1

| Sample | | Kinematic viscosity at 40° C. (cst) | Kinematic viscosity at 100° C. (cst) | Viscosity index | Traction coefficient |
|---|---|---|---|---|---|
| Example | $A_1$ | 25.73 | 4.33 | 53 | 0.101 |
| | $A_2$ | 27.71 | 4.52 | 55 | 0.102 |
| | $A_3$ | 29.40 | 4.81 | 73 | 0.102 |
| Comp. Ex. | B | 13.84 | 2.99 | 46 | 0.087 |
| | $C_1$ | 8.64 | 2.17 | 24.8 | 0.086 |
| | $C_2$ | 69.63 | 5.94 | −66.5 | 0.090 |
| | D | 262.6 | 9.905 | −184 | — (impossible to measure due to too high a viscosity) |

The traction fluid of the present invention comprises a diester having two cyclohexyl rings and not only exhibits an extremely high traction coefficient but is also inexpensive and exhibits excellent viscosity characteristics.

Therefore, the use of the traction fluid of the present invention in a power transmission, particularly a traction drive device, leads to a remarkable increase in shearing force under high load, this enables a reduction in both size and cost of the device.

What is claimed is:

1. A traction fluid comprising a major amount of diester or its derivative represented by the formula

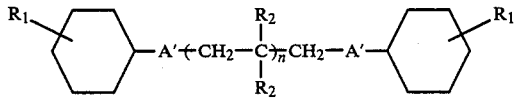

wherein

A′ is an ester linkage of —COO— or —OOC—, n is an integer of 1 to 6, $R_1$ is independently selected from the group consisting of hydrogen and alkyls containing from 1 to 8 carbon atoms, and $R_2$ is independently alkyls containing from 1 to 3 carbon atoms; and minor amount of at least one material selected from the group consisting of antioxidants, wear inhibitors, corrosion inhibitors and viscosity index improvers.

2. The traction fluid of claim 1 wherein $R_1$ is independently selected from the group consisting of hydrogen and $C_1$ to $C_4$ alkyl.

3. The traction fluid composition of claim 2 wherein n is an integer of 1 to 2.

4. The traction fluid composition of claim 1 wherein n is an integer of 1 to 5.

5. The traction fluid of claim 1 wherein $R_2$ is methyl.

6. The traction fluid of claim 2 wherein $R_2$ is methyl.

7. The traction fluid of claim 3 wherein $R_2$ is methyl.

8. The traction fluid of claim 4 wherein $R_2$ is methyl.

9. The traction fluid composition of claim 1 wherein $R_1$ is hydrogen.

10. A traction fluid composition comprising a major amount of base oil comprised of at least one diester or its derivative represented by the formula

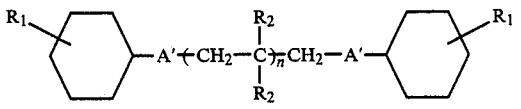

wherein

A′ is an ester linkage of —COO— or —OOC—, n is an integer of 1 to 6;

$R_1$ is independently selected from the group consisting of hydrogen and alkyls containing from 1 to 8 carbon atoms, and $R_2$ is independently alkyls containing from 1 to 3 carbon atoms; and a minor amount of at least one material selected from the group consisting of antioxidants, wear inhibitors, corrosion inhibitors and viscosity index improvers.

11. The traction fluid composition of claim 10 wherein $R_1$ is hydrogen.

* * * * *